US005320237A

United States Patent [19]

Stolzman

[11] Patent Number: 5,320,237

[45] Date of Patent: Jun. 14, 1994

[54] SEALED CLOSURE FOR DRUM

[76] Inventor: Michael L. Stolzman, 1188 Old Colony Rd., Lake Forest, Ill. 60045

[21] Appl. No.: 912,520

[22] Filed: Jul. 13, 1992

[51] Int. Cl.[5] ..... B65D 51/20; B65D 1/02

[52] U.S. Cl. ..... 220/257; 215/31; 215/251; 220/288; 220/601; 285/21; 285/202

[58] Field of Search ..... 215/31, 232, 251, 329, 215/344; 220/257, 288, 601, 661; 285/21, 201, 202, 286

[56] References Cited

U.S. PATENT DOCUMENTS

| | | | |
|---|---|---|---|
| 3,353,849 | 11/1967 | Laurizio | 285/21 |
| 3,873,132 | 3/1975 | Czerwiak | 285/21 |
| 3,958,719 | 5/1976 | Ward | 220/288 |
| 4,246,859 | 1/1981 | Beckerer, Jr. | 220/288 X |

*Primary Examiner*—Allan N. Shoap

*Assistant Examiner*—Nova Stucker

*Attorney, Agent, or Firm*—Wood, Phillips, VanSanten, Hoffman & Ertel

[57] ABSTRACT

A closure is used for selectively closing an opening of a container, the container including a tubular collar defining an opening and surrounded at the opening by an annular collar flange. An embossment includes a tubular collar retainer having an outer diameter slightly less than an inner diameter of the container collar and defining a through passage. A cap is threaded into the through passage to close the same. An annular retainer flange extends outwardly from an outer wall of the collar retainer and is seated on the collar flange incident to the retainer being inserted in the container collar. The retainer flange is secured to the collar flange by vibration welding so that the cap closes the container opening.

12 Claims, 3 Drawing Sheets

SEALED CLOSURE FOR DRUM

FIELD OF THE INVENTION

This invention relates to a container and, more particularly, to a sealed closure for a container.

BACKGROUND OF THE INVENTION

In one form of a typical shipping and storage container, a cylindrical drum is used. Particularly, the drum has a cylindrical sidewall closed by a bottom wall. The top is closed by a removable top wall or a fixed wall having a through opening. A typical such container has the sidewall and the bottom wall formed of a fiber material connected by a rolled metal rim. The top may be of metal or plastic and is connected to the sidewall using a locking band. In applications where the drum is ultimately incinerated the use of metal is undesirable. Further, such containers may be less than desirable for containing liquids.

More recently, drums have been formed entirely of plastic. These drums are blow molded of high load melt index resin. The drum has an integral sidewall, top wall and bottom wall. A pair of threaded openings are provided in the top wall, each being selectively closed by a threaded closure. Inherent in the blow molding process is the existence of a parting line where the two mold halves separate. Often, the separation is located across the threaded opening. As a result, tolerances are difficult to maintain. This can lead to leakage problems if the closure does not thread properly in the opening.

Under specified safety regulations a safety seal may be required to further prevent leakage at the closure. A typical seal is a crimped metal safety cap. This again results in a container having some metal content.

The present invention is intended to solve one or more of the problems discussed above in a novel and simple manner.

SUMMARY OF THE INVENTION

In accordance with the invention there is disclosed a closure connected to a container by vibration welding.

Broadly, there is disclosed herein a closure for selectively closing an opening of a container, the container including a tubular collar defining the opening and surrounded at the opening by an annular collar flange. The closure comprises an embossment including a tubular collar retainer having an outer diameter slightly less than the inner diameter of the container collar and defining a through passage. An inner surface of the collar is threaded. An annular retainer flange extends outwardly from an outer wall of the collar retainer, the retainer flange seating on the collar flange incident to the retainer being inserted in the container collar. A cap is threaded to the retainer inner surface to removably close the through passage. Securing means are provided for securing the embossment to the container comprising a circular bead integral with the retainer flange and disposed between the collar flange and retainer flange for vibration welding the retainer flange to the collar flange so that the cap closes the container opening.

It is a feature of the invention that the cap includes a cap flange and a resilient seal is secured to the cap adjacent the cap flange providing a seal between the cap flange and the retainer flange.

It is another feature of the invention to provide a safety seal vibration welded to the retainer flange in overlying relationship with the cap for providing a tamper evident seal.

It is a further feature of the invention that the embossment is integrally formed in a unitary construction.

It is an additional feature of the invention that the embossment is formed of high load melt index resin.

It is still another feature of the invention that the closure further comprises an annular ridge on the embossment below the flange extending radially beyond the container collar providing a snap fit connection.

In accordance with another aspect of the invention there is disclosed in a container including a tubular collar defining an opening surrounded by an annular collar flange, a closure providing selective access to the opening. The closure comprises an embossment including a tubular collar retainer received in the collar and defining a through passage. An annular retainer flange extends outwardly from an outer Wall of the collar retainer, the retainer flange seating on the collar flange incident to the retainer being inserted in the container collar. A cap is removably secured within the collar retainer through passage. Means are provided for securing the retainer flange to the collar flange by vibration welding the retainer flange to the collar flange so that the cap closes the container opening.

In accordance with yet another aspect of the invention there is disclosed a method of sealing an opening of a plastic container, the container including a tubular collar defining the opening and surrounded at the opening by an annular collar flange. The method comprises the steps of providing an embossment including a tubular collar retainer having an outer diameter slightly less than an inner diameter of the container collar and defining a through passage, an inner wall of the retainer defining the through passage being threaded, and an annular retainer flange extending outwardly from an outer wall of the collar retainer; threading a cap into the through passage; inserting the embossment in the container collar, the retainer flange seating on the collar flange incident to the retainer being inserted in the container collar; and Joining the embossment to the container as by vibration welding the retainer flange to the collar flange so that the cap closes the container opening.

It is a feature of the invention that the joining step comprises the step of sonically welding the flanges together.

It is another feature of the invention that the threading step is performed prior to the inserting step.

It is a further feature of the invention that the inserting step comprises snap fitting the closure into the container collar.

More specifically, a complete closure assembly is provided which can be snap fit into a drum opening with a cap pretorqued to a collar retainer before assembly and a safety seal being provided integrally with the retainer. After insertion of the retainer in the bottle collar opening, a flange of the retainer is vibrational welded to a flange of the drum collar. This provides safety for the end user as by having a tamper evident closure, assuring sanitation by the seal .being in the flange, simplifying carton configuration, minimizing leakage, and eliminating the step of fixing a seal and the cap at a filling plant. Further features and advantages of the invention will readily be apparent from the specification and from the drawings.

DETAILED DESCRIPTION OF THE INVENTION

Figure 1:
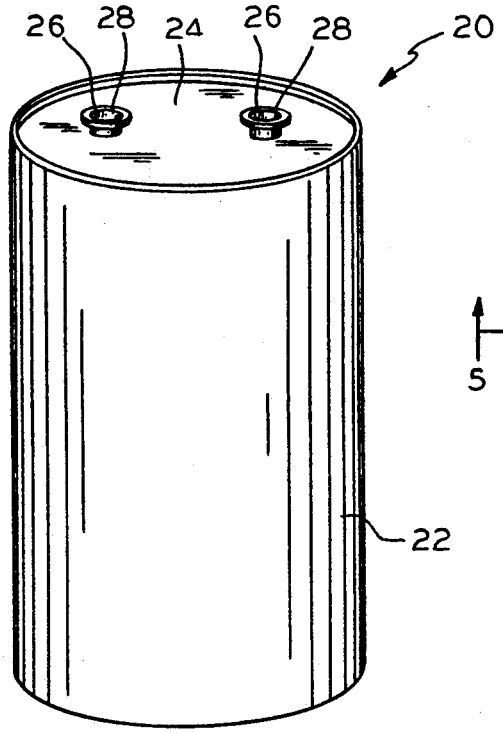
FIG. 1 is an elevation view of a container in the form of a plastic, fifty-five gallon drum including the sealed closure according to the invention.

In the illustrated embodiment of the invention, as disclosed in the drawing, a container 20 is shown to comprise a fifty-five gallon drum, such as typically used as a shipping and storage container for bulk liquids. The drum 20 in its most common form is blow molded using a resin such as high load melt index. The drum 20 has a cylindrical sidewall 22 closed by a bottom wall (not shown) and a top wall 24.

Figure 2:
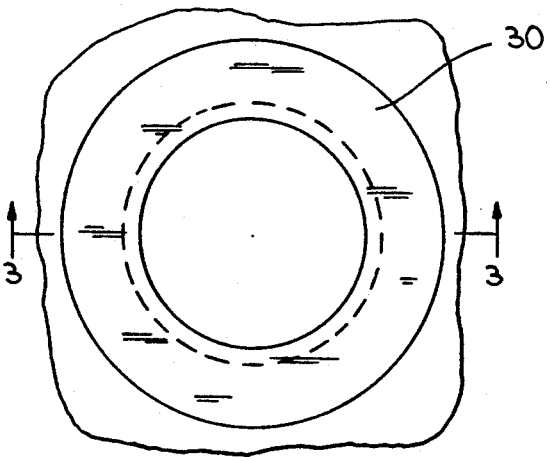
FIG. 2 is a top view showing a collar portion of the container of FIG. 1 without the closure.
Figure 3:
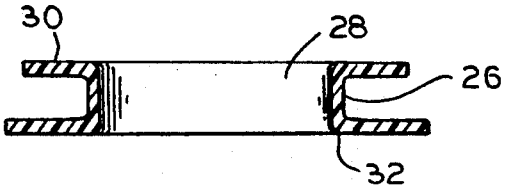
FIG. 3 is a partial, sectional view of the container of taken along the line 3—3 of FIG. 2.

With reference also to FIGS. 2 and 3, the drum 20 includes a pair of tubular collars 26 defining openings 28 for filling and emptying the drum 20. Each collar 26 is surrounded at the opening 28 by an annular collar flange 30. A lower edge 32 is provided in the collar 26 spaced below the flange 30.

Figure 6:
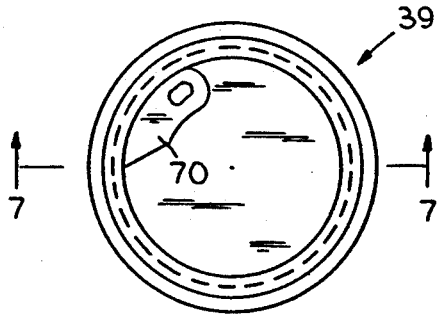
FIG. 6 is a top plan view of a safety seal for securing to the embossment of FIG. 4.
Figure 7:
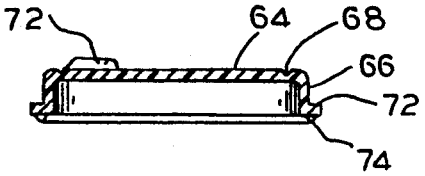
FIG. 7 is a sectional view taken along the line 7—7 of FIG. 6.
Figure 8:
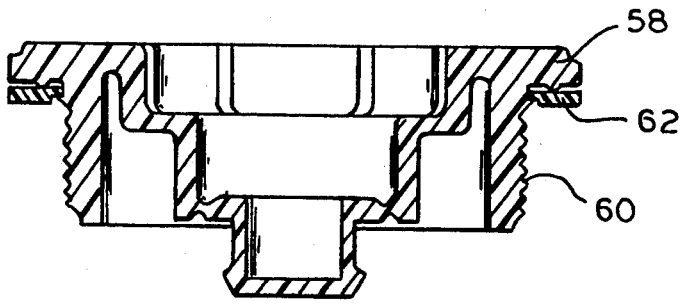
FIG. 8 is a sectional view of a cap for the closure of the invention.
Figure 9:
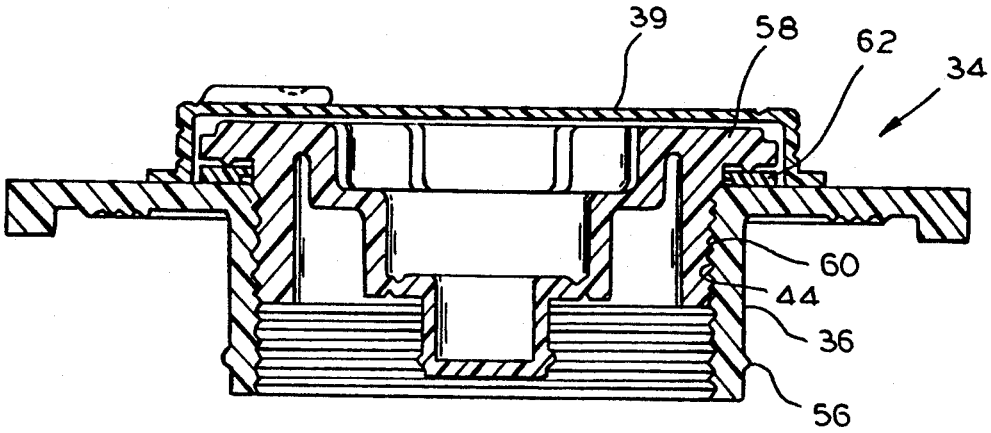
FIG. 9 is a sectional view showing the closure assembly including the embossment of FIG. 5, the safety seal of FIG. 7 and the cap of FIG. 8.

In accordance with the invention, the drum 20 is provided with a closure assembly 34, see FIG. 9, for providing a sealed closure for each opening 28. Each closure assembly 34 comprises an embossment 36, see FIGS. 4 and 5, a cap 38, see FIG. 8, and a safety seal 39, see FIGS. 6 and 7.

Figure 4:
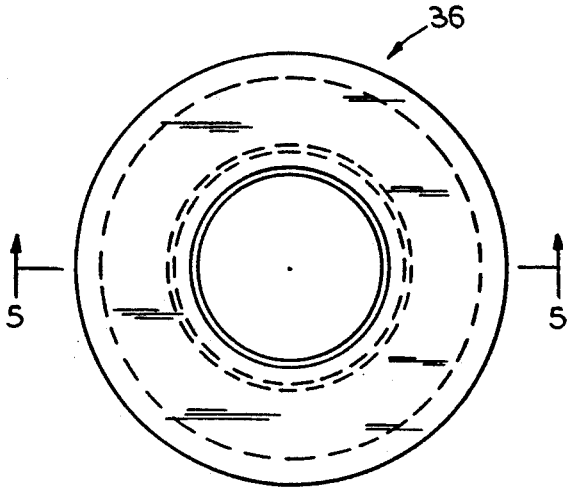
FIG. 4 is a top plan view of the closure embossment of FIG. 1 prior to assembly to the container.
Figure 5:
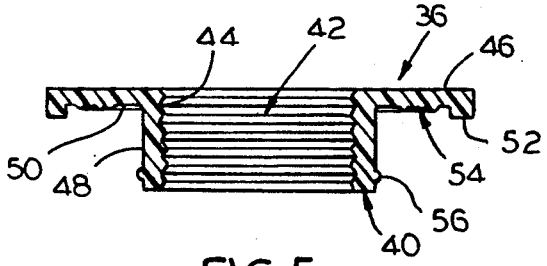
FIG. 5 is a sectional view taken along the line 5—5 of FIG. 4.

With reference to FIGS. 4 and 5, the embossment 36 comprises a tubular collar retainer 40 having an outer diameter slightly less than an inner diameter of the container collar 26, see FIG. 3. The retainer 40 defines a through passage 42. The retainer 40 includes a threaded inner surface 44 defining the through passage 42. A retainer flange 46 extends radially outwardly from an outer wall 48 of the retainer 40. A lower surface 50 of the flange 46 includes an outer circumferential ridge 52 having an inner diameter slightly greater than the outer diameter of the container collar 30. Also included are a plurality of coaxial circular beads 54. The flange 46, including the ridge 52 and beads 54 are integrally formed with the retainer 40 of a high load melt index resin. Finally, the retainer 40 includes a radially outwardly extending integral annular ridge 56 below the flange 46. The spacing between the ridge 56 and the flange lower surface 50 is selected to be the same as the spacing between the container collar edge 32 and the collar flange 30.

The retainer threaded inner surface 44 enables the cap 38 to be screwed therein. Particularly, with reference to FIG. 8, the cap 38 is of conventional construction and includes a cap flange 58 and a threaded outer surface 60 for threading in the retainer inner surface 44, see FIG. 9. A resilient seal in the form of a gasket 62 surrounds the cap outer surface 60 below the flange 58. The gasket 62 seals the cap flange 58 against the retainer flange 46, see FIG. 9. Particularly, the closure assembly can be provided complete as shown in FIG. 9 with the cap 38 threadably connected to the embossment 36 prior to installing the same on the drum 20. This allows the cap 38 to be tightened to a suitable torque at the time of manufacturing of the closure assembly 34. Indeed, both the cap 38 and embossment 36 can be formed by injection molding. This results in a more reliable threaded connection between the cap 38 and embossment 36 to virtually eliminate leakage through the closure during use on the container 20.

The safety seal 39 provides a form of tamper evident protection. The safety seal 39 comprises a circular wall 64 connected to a cylindrical sidewall 66 with a frangible connection 68. The safety seal 39 is integrally formed by injection molding. The frangible connection 68 is of thinner cross section than the remainder of the seal 39. Thus, by grasping a tab 70 integral with the circular wall 64, the connection 68 can be broken to remove the circular wall 64.

The seal sidewall 66 includes a lower flange 72 having a circular bead 74. After the cap 38 is secured to the embossment, as discussed above relative to FIG. 9, the safety seal 39 is vibration welded to the embossment 36. Particularly, the seal flange 72 is placed atop the retainer flange 46. The flanges 72 and 46 are welded together using suitable welding apparatus (not shown). The circular bead 74 acts as an energy director to concentrate energy to rapidly initiate softening and melting at the Joining surface. The safety seal 39 thus seals the cap 38 to the embossment 36.

Figure 10:
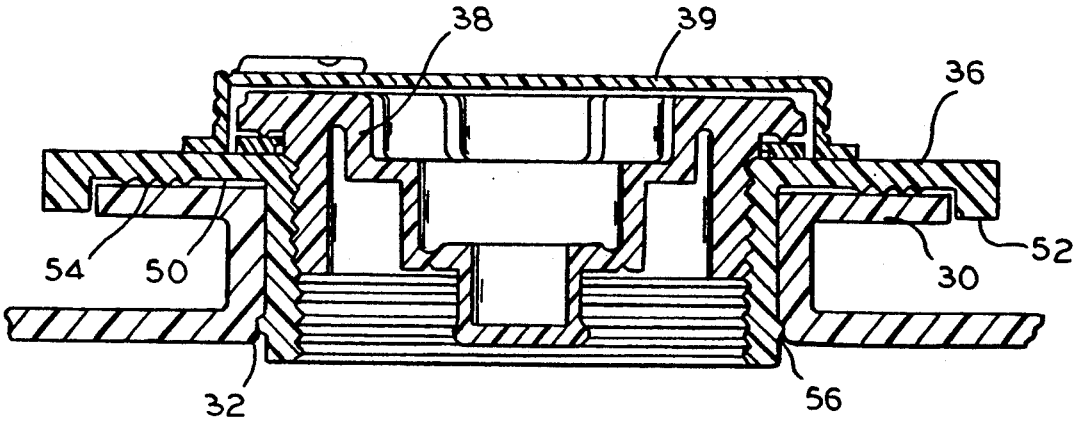
FIG. 10 is a partial, sectional view showing the assembly of FIG. 9 installed on the drum collar of FIG. 3.

To install the closure assembly 34 on the drum 20, the closure assembly 34 is inserted in the container collar 26, as shown in FIG. 10. In so doing, the retainer ridge 56 is snap fit into the collar 26 at the edge 32 to locate and hold down the closure assembly 34. Owing to the spacing discussed above, the retainer flange 46 at its lower surface 50 is seated on the container collar flange 30, as shown, with the circular beads 54 bearing on the collar flange 30. The ridge 52 surrounds the collar flange 30.

In use, the closure assembly 34 can be snap fit to the container 20 at the manufacturing site prior to filling. This prevents dirt and dust from entering the openings 28 during shipment to a customer. The customer then removes the closure assembly 34, fills the container 20 and then replaces the closure assembly 34.

Figure 11:
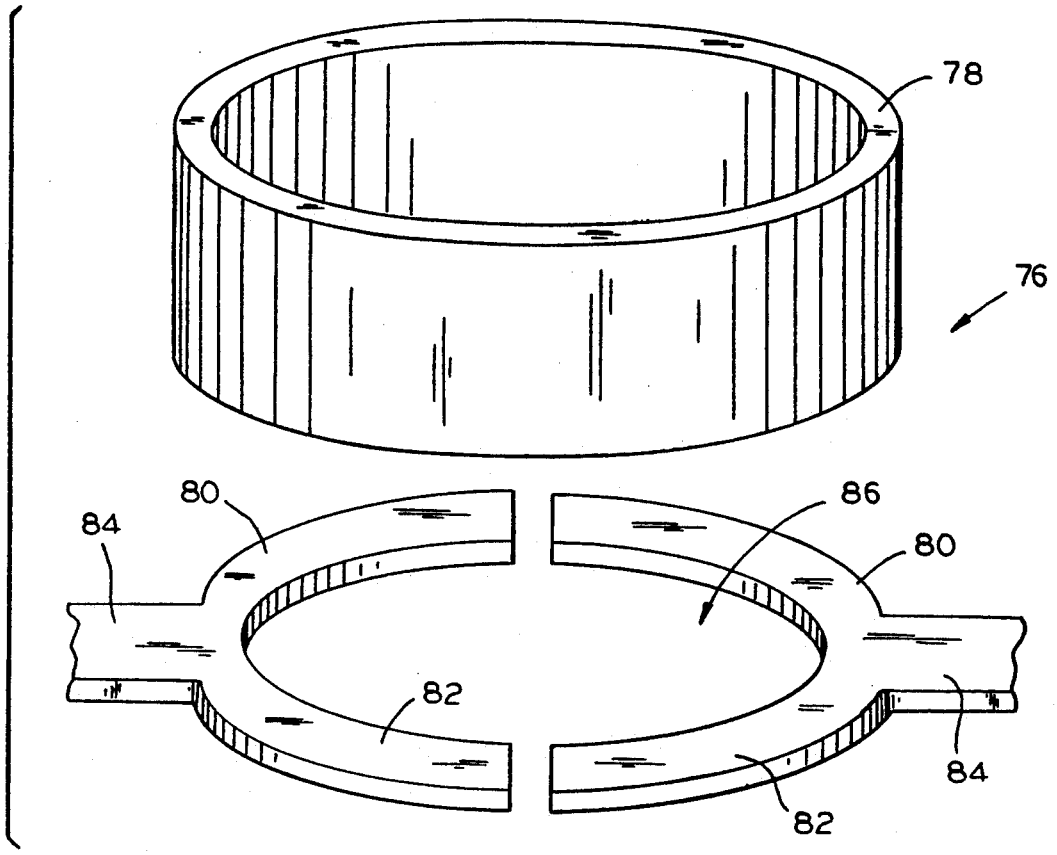
FIG. 11 is a perspective view illustrating a fixture assembly for securing the closure assembly to the drum.
Figure 12:
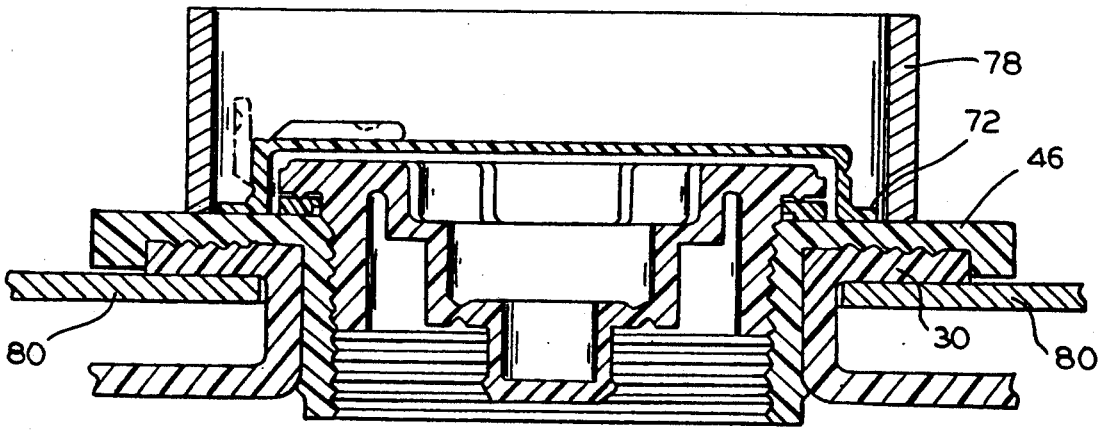
FIG. 12 is a partial, sectional view showing use of the fixture assembly of FIG. 11 for securing the closure assembly and container of FIG. 10 together.

In accordance with the invention, the closure assembly 34 is joined to the container 20 as by vibration welding the retainer flange 46 to the container flange 30 so that the seal 39 and cap 38 seal the container opening 28. To accomplish this joining step, a fixture assembly 76, see FIG. 11, is used. The fixture assembly 76 includes a tubular vibrating element 78 having an inner diameter greater than an outer diameter of the seal flange 72 and an outer diameter less than an outer diameter of the retainer collar 46, as shown in FIG. 12. The fixture assembly 76 also includes a pair of Y-shaped supports 80. Each support 80 comprises one-half of an annular ring 82 connected by a leg 84. When positioned as shown in FIG. 11, a generally circular opening 86 is provided between the two supports 80. The opening 86 is of a size slightly larger than the outer diameter of the container collar 26.

During the assembly process, after the drum 20 has been filled and each closure assembly 34 inserted, as discussed above, the supports 80 are positioned with the container collar 26 disposed in the opening 86, as shown in FIG. 12. The tubular vibrating element 78 is then positioned so that it engages the retainer flange 46. Particularly, the retainer flange 46 and collar flange 30 are sandwiched between the supports 80 and the vibrating element 78. The vibrating element 78 is vibrated by conventional means, not shown, to ultrasonically weld the retainer flange 46 to the collar flange 30. Particularly, the element 78 is vibrated at an ultrasonic frequency. The circular beads 54 act as energy directors to concentrate energy to rapidly initiate softening and melting at the joining surface. Because the beads 54 extend around the entire retainer flange 46, the Joint interface is uniform and in intimate contact with the collar flange 30 on a single plane. This enables uniform transfer of energy for consistent melting and welding. This ultrasonic welding provides a structural bond and seal between the collar flange 30 and retainer flange 46 to prevent leakage.

With the described closure assembly, safety is provided for the end user by having the seal 39 preventing tampering with the contents of the container 20 without breaking the frangible connection 68. Thus, a tamper evident seal is provided. Sanitation is provided by the seal being in the flange connection without the use of adhesives or the like. Further, the described construction simplifies configuration of the drum by eliminating the requirements for threading in the drum itself or a ratchet connection. The construction also uses precision assembled cap and embossment to minimize leakage and provide a construction where the cap is preinstalled prior to inserting the closure assembly in the container.

The foregoing disclosure of the specific embodiment illustrates the broad invention concepts comprehended by the invention.

I claim:

1. In combination, a closure for selectively closing an opening of a container, the container including a tubular collar defining the opening and surrounded at the opening by an annular collar flange, comprising:

an embossment including a tubular collar retainer having an outer diameter slightly less than an inner diameter of the container collar and defining a through passage, an inner surface of the retainer being threaded, and an annular retainer flange extending outwardly from an outer wall of the collar retainer, said retainer flange seating on the collar flange incident to said retainer being inserted in the container collar;

a cap threaded to said retainer inner surface to removably close said through passage;

securing means for securing said embossment to the container comprising a circular bead integral with the retainer flange and disposed between the collar flange and the retainer flange for vibration welding the retainer flange to the collar flange so that the cap closes the container opening; and a safety seal vibration welded to said retainer flange in overlying relation with said cap for providing a tamper evident seal for said through passage.

2. The closure of claim 1 wherein said cap includes a cap flange and further comprising a resilient seal secured to said cap adjacent said cap flange providing a seal between said cap flange and said retainer flange.

3. The closure of claim 1 wherein said embossment is integrally formed in a unitary construction.

4. The closure of claim 3 wherein said embossment is formed of high load melt index resin.

5. In combination, a closure for selectively closing an opening of a container, the container including a tubular collar defining the opening and surrounded at the opening by an annular collar flange, comprising:

an embossment including a tubular collar retainer having an outer diameter slightly less than an inner diameter of the container collar and defining a through passage, an inner surface of the retainer being threaded, and an annular retainer flange extending outwardly from an outer wall of the collar retainer, said retainer flange seating on the collar flange incident to said retainer being inserted in the container collar;

a cap threaded to said retainer inner surface to removably close said through passage;

securing means for securing said embossment to the container comprising a circular bead integral with the retainer flange and disposed between the collar flange and the retainer flange for vibration welding the retainer flange to the collar flange so that the cap closes the container opening; and an annular ridge on said embossment below said flange extending radially beyond said container collar providing a snap fit connection.

6. The closure of claim 5 further comprising a safety seal vibration welded to said retainer flange in overlying relation with said cap for providing a tamper evident seal for said through passage.

7. In combination, a container including a tubular collar defining an opening surrounded by an annular collar flange, and a closure providing selective access to said opening, comprising:

an embossment including a tubular collar retainer received in said collar and defining a through passage, and an annular retainer flange extending outwardly from an outer wall of the collar retainer, said retainer flange seating on the collar flange incident to said retainer being inserted in the container collar;

a cap removably secured within said collar retainer through passage; and means for securing said retainer flange to said collar flange by vibration welding the retainer flange to the collar flange so that the cap closes the container opening.

8. The combination of claim 7 wherein said cap includes a cap flange and further comprising a resilient seal secured to said cap adjacent said cap flange providing a seal between said cap flange and said retainer flange.

9. The combination of claim 7 further comprising a safety seal vibration welded to said retainer flange in overlying relation with said cap for providing a tamper evident seal for said through passage.

10. The combination of claim 7 wherein said closure further comprises an annular ridge on said outer wall extending radially beyond said container collar providing a snap fit connection.

11. The combination of claim 7 wherein said embossment is integrally formed in a unitary construction.

12. The combination of claim 11 wherein said embossment is formed of high load melt index resin.

* * * * *